US005894621A

United States Patent [19]

Kubo

[11] Patent Number: 5,894,621

[45] Date of Patent: Apr. 20, 1999

[54] UNMANNED WORKING VEHICLE

[75] Inventor: Naoki Kubo, Nishinomiya, Japan

[73] Assignee: Minolta Co., Ltd., Osaka, Japan

[21] Appl. No.: 08/826,058

[22] Filed: Mar. 26, 1997

[51] Int. Cl.[6] ..... A47L 11/10; A47L 11/16; A47L 11/28; A47L 11/282

[52] U.S. Cl. ..... 15/50.1; 15/319; 15/320; 180/6.5

[58] Field of Search ..... 15/50.1, 79.2, 15/319, 320, 340.1, 340.3; 180/6.5; 280/755, 757; 901/1

[56] References Cited

U.S. PATENT DOCUMENTS

| | | | |
|---|---|---|---|
| 4,369,543 | 1/1983 | Chen et al. | 15/319 |
| 4,483,041 | 11/1984 | Waldhauser et al. | 15/320 |
| 5,109,566 | 5/1992 | Kobayashi et al. . | |
| 5,279,672 | 1/1994 | Betker et al. . | |
| 5,293,955 | 3/1994 | Lee . | |
| 5,309,592 | 5/1994 | Hiratsuka | 15/319 |
| 5,341,540 | 8/1994 | Soupert et al. | 15/319 |
| 5,363,937 | 11/1994 | James | 180/6.5 |
| 5,402,051 | 3/1995 | Fujiwara et al. . | |
| 5,613,261 | 3/1997 | Kawakami et al. | 15/319 |
| 5,659,918 | 8/1997 | Anthony et al. | 15/320 |
| 5,720,077 | 2/1998 | Nakamura et al. | 15/319 |

FOREIGN PATENT DOCUMENTS

| | | | |
|---|---|---|---|
| 4-260905 | 9/1992 | Japan . | |
| 7-289488 | 11/1995 | Japan . | |
| 2225221 | 5/1990 | United Kingdom | 15/319 |

*Primary Examiner*—Terrence R. Till
*Attorney, Agent, or Firm*—McDermott, Will & Emery

[57] ABSTRACT

An unmanned working vehicle of the present invention comprises a work mechanism section which performs a specified work, and a main body section having a wheel for moving said unmanned working vehicle and a driver for driving said work mechanism section or said main body section, wherein said driver having a weight and being arranged on the side opposite from said work mechanism section relative to said wheel, whereby the center of gravity of said unmanned working vehicle is located on or near said wheel.

13 Claims, 5 Drawing Sheets

UNMANNED WORKING VEHICLE

BACKGROUND OF THE INVENTION

The present invention relates to autonomous movement type unmanned working vehicles, and in particular, to an unmanned working vehicle of which movement is consistently stabilized.

The present inventor has developed, for example, one which performs a specified work such as a cleaning work or a conveyance work while moving on a floor surface as an autonomous movement type unmanned working vehicle which autonomously moves while detecting the existence of an obstacle around it. This kind of unmanned working vehicle is comprised of a work mechanism section for performing the aforementioned specified works and a main body section provided with a drive means for moving the unmanned working vehicle. Further, when performing a cleaning work with the work mechanism section, the main body section is sometimes mounted with a solution tank for storing therein a cleaning solution for the cleaning.

With regard to the aforementioned unmanned working vehicle, there has been no consideration for the arrangement of the work mechanism section, the main body section and the solution tank. That is, there has been no consideration for the position of the center of gravity of the entire unmanned working vehicle. Therefore, there has been problems that, a driving wheel may slip or behave similarly, to possibly cause a shaking when the unmanned working vehicle moves, leading to an unstable movement depending on the position of the center of gravity.

SUMMARY OF THE INVENTION

Accordingly, it is an object of the present invention to provide an unmanned working vehicle of which movement is consistently stabilized.

In order to solve the aforementioned problems, the present invention provides an unmanned working vehicle comprises a work mechanism section which performs a specified work, and a main body section having a wheel for moving said unmanned working vehicle and a driver for driving said work mechanism section or said main body section, wherein said driver having a weight and being arranged on the side opposite from said work mechanism section relative to said wheel, whereby the center of gravity of said unmanned working vehicle is located on or near said wheel.

Accordingly, a sufficient weight is consistently rested on the driving wheel. For this reason, the driving wheel hardly slips, thereby allowing an unmanned working vehicle of which movement is consistently stabilized to be obtained.

Furthermore, in order to solve the aforementioned problems, the unmanned working vehicle of the present invention further comprises a weight changing section of which weight changes as a consequence of said specified work or said driving said main body section, wherein said weight changing section being arranged between said driver and said work mechanism section.

Therefore, the shift of the position of the center of gravity of the unmanned working vehicle caused by the change in weight as a consequence of the specified works or driving the main body section is eliminated or minimized, thereby allowing an unmanned working vehicle of which movement is consistently stabilized to be obtained. Accordingly, a sufficient weight is consistently rested on the driving wheel. For this reason, the driving wheel hardly slips, thereby allowing an unmanned working vehicle of which movement is consistently stabilized to be obtained.

These and other objects and features of the present invention will be apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Figure 1:
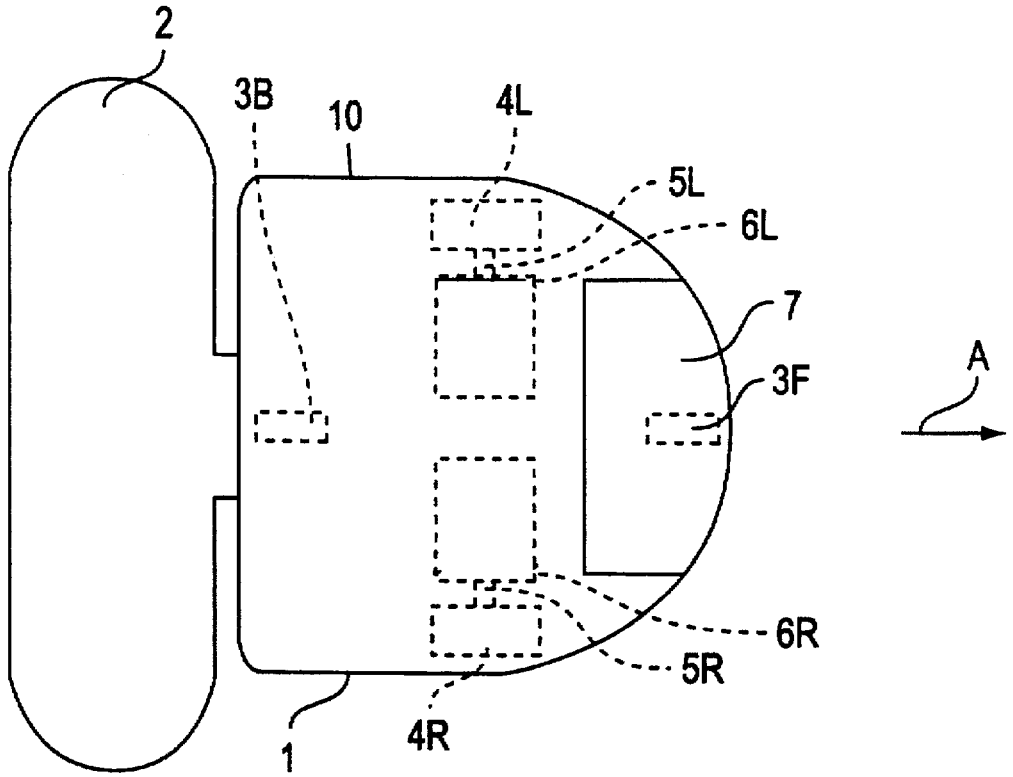
FIG. 1 is a plan view of an unmanned working vehicle of a first embodiment of the present invention.

Embodiments of the present invention will be described with reference to the accompanying drawings. It is to be noted that the same reference numerals in the figures denote the same or corresponding components.

(1) First embodiment

Figure 2:
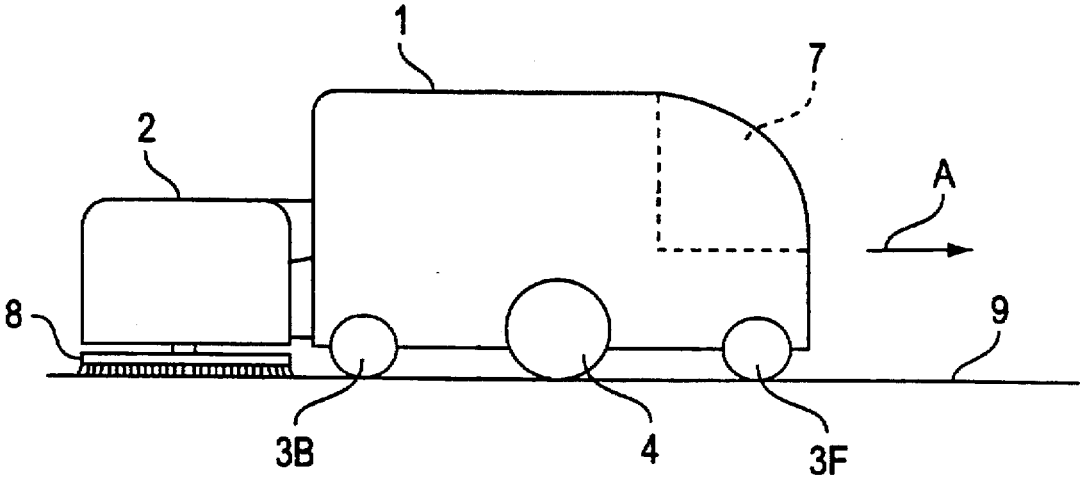
FIG. 2 is a side view of the unmanned working vehicle of the first embodiment of the present invention.

FIGS. 1 and 2 show a plan view and a side view of an unmanned working vehicle of a first embodiment of the present invention. The unmanned working vehicle of the first embodiment is comprised of a main body section 1 having a drive mechanism and a steering mechanism for moving the unmanned working vehicle and a work mechanism section 2 for performing a cleaning work. It is to be noted that the unmanned working vehicle advances in a direction indicated by an arrow "a". The work mechanism section 2 is supported in a state in which it can move in the lateral direction (the direction perpendicular to the direction of the arrow "a" in FIG. 1) of the main body section 1 by a slide mechanism (not shown). Further, the main body section 1 includes auxiliary wheels 3F and 3B, driving wheels 4R and 4L, driving wheel motors 6R and 6L and a battery 7, while the work mechanism section 2 includes a brush 8 for cleaning a floor surface 9. It is to be noted that the battery 7 is indicated by solid lines in FIG. 1 for ease of understanding.

In this case, the driving wheel 4R is mounted on the right-hand side of the main body section 1 with respect to the direction in which the unmanned working vehicle advances (the direction indicated by the arrow "a"). To the driving wheel 4R is transmitted the rotation of the driving wheel motor 6R via a connection mechanism 5R. Similarly, the driving wheel 4L is mounted on the left-hand side of the main body section 1, and the rotation of the driving wheel motor 6L is transmitted to the driving wheel 4L via a connection mechanism 5L. That is, since the driving wheel motors 6R and 6L can be controlled in a different manner, the driving wheels 4R and 4L can be controlled independently of each other.

Then, by rotating the left and right driving wheels 4L and 4R in the same direction, the unmanned working vehicle is moved forwardly or reversely. That is, the unmanned working vehicle is allowed to move. Further, by a control for increasing and decreasing the number of rotations of either one of the driving wheels 4L and 4R, the unmanned working vehicle is made to move in a curving manner. Although not shown, the driving wheel motors 6L and 6R are each provided with an encoder at the other end of their drive shafts, so that the amounts of rotations and the rotational speeds of the driving wheel motors 6L and 6R can be detected from an output of the encoder. Therefore, it is possible to detects a distance covered from the output of the encoder. It is to be noted that, as shown in FIG. 2, the driving wheels 4 (4R and 4L) are arranged in a center portion of the main body section 1.

At the front of the main body section 1 is mounted the auxiliary wheel 3F that can rotate in an arbitrary direction relative to the direction in which the unmanned working vehicle advances. It is to be noted that the auxiliary wheel 3F has a suspension mechanism capable of moving in the vertical direction relative to the floor surface 9. Similarly, at the rear of the main body section 1 is mounted the auxiliary wheel 3B. It is to be noted that the auxiliary wheel 3B may have the aforementioned suspension mechanism. That is, at least one of the auxiliary wheels 3F and 3B is required to have the suspension mechanism.

Figure 7:
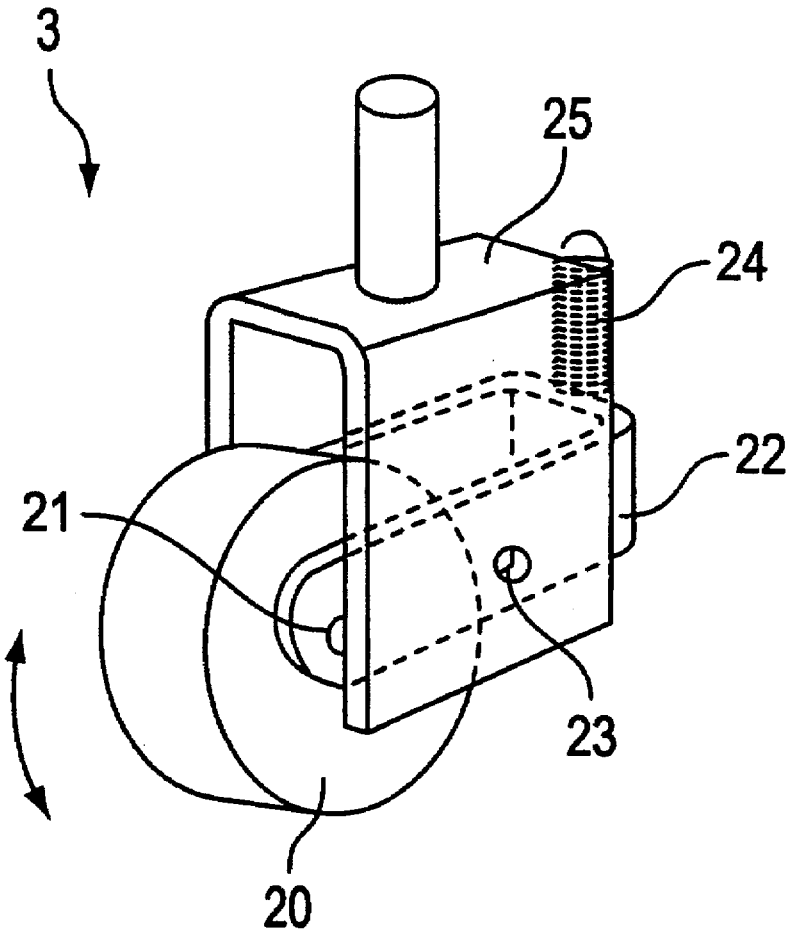
FIG. 7 is a perspective view of a suspension mechanism provided at an auxiliary wheel of the unmanned working vehicles of the first and second embodiments of the present invention.

The suspension mechanism is described below. As shown in FIG. 7, the auxiliary wheel 3F includes a wheel 20, a wheel retaining section 22, a spring 24 and a support section 25. The wheel 20 is rotatably mounted to the wheel retaining section 22 by a wheel rotary shaft 21, while the wheel retaining section 22 is mounted to the support section 25 by a connection shaft 23 pivotally in a vertical plane relative to the floor surface 9. Outside the support section 25 is mounted an end of the spring 24 that can expand and contract in the vertical direction, while the other end of the spring 24 is connected to a part of the wheel retaining section 22. With the suspension mechanism as described above, even when the unmanned working vehicle is moving on a floor surface which is uneven, the four wheels (3F, 3B, 4R and 4L) consistently come in contact with the floor surface 9. Furthermore, the possible slip of the driving wheels 4 (4R and 4L) is avoided, so that a stable movement can be achieved.

In the unmanned working vehicle of the first embodiment, the battery 7 is provided above the auxiliary wheel 3F in a front portion of the main body section 1. That is, the battery 7 is arranged on the side opposite from the work mechanism section 2 with respect to the driving wheels 4. In this unmanned working vehicle, the weight of the battery 7 and the weight of the work mechanism section 2 share a greater part of the weight of the entire unmanned working vehicle.

Figure 3:
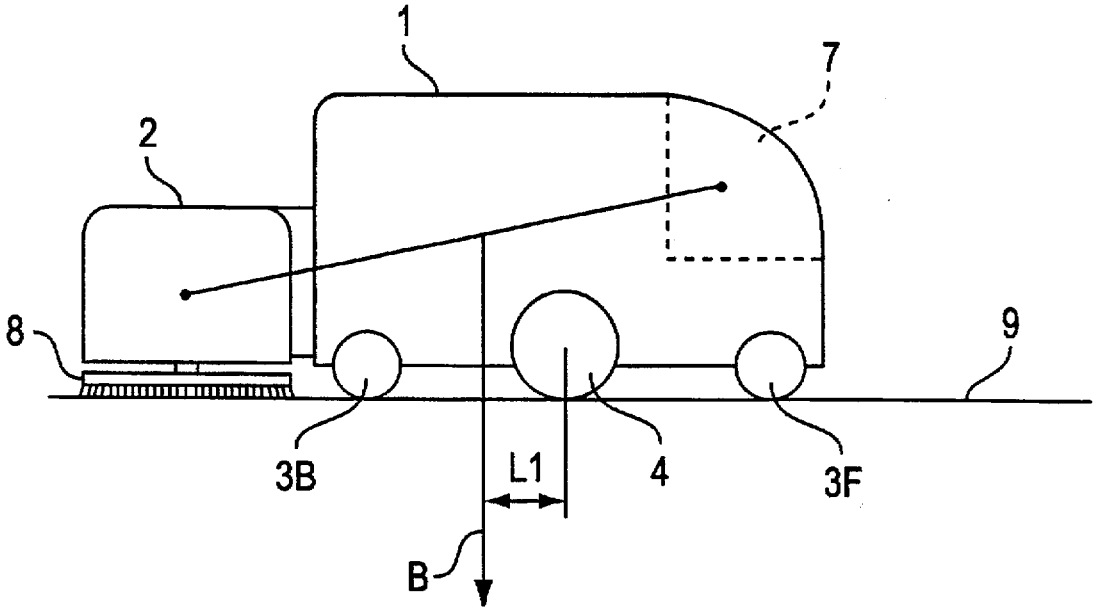
FIG. 3 is a side view for explaining the position of the center of gravity of the unmanned working vehicle of the first embodiment of the present invention.

FIG. 3 is a side view for explaining the position of the center of gravity of the unmanned working vehicle owing to the battery 7 and the work mechanism section 2. The position B of the center of gravity of the unmanned working vehicle owing to the battery 7 and the work mechanism section 2 is located at a center portion of the unmanned working vehicle, i.e., in a position near the driving wheels 4. Therefore, a sufficient weight is consistently rested on the driving wheels 4. Therefore, the above arrangement is free from the concern that the driving wheels 4 may slip due to the exertion of a force for lifting up the driving wheels 4 with the axle of the auxiliary wheel 3B made to serve as a fulcrum as a consequence of, for example, the application of a great force to the auxiliary wheel 3B rather than to the driving wheels 4 with the center of gravity deviated rearwardly of the main body section 1 of the unmanned working vehicle, so that an unmanned working vehicle with excellent moving stability can be obtained.

(2) Second embodiment

Figure 4:
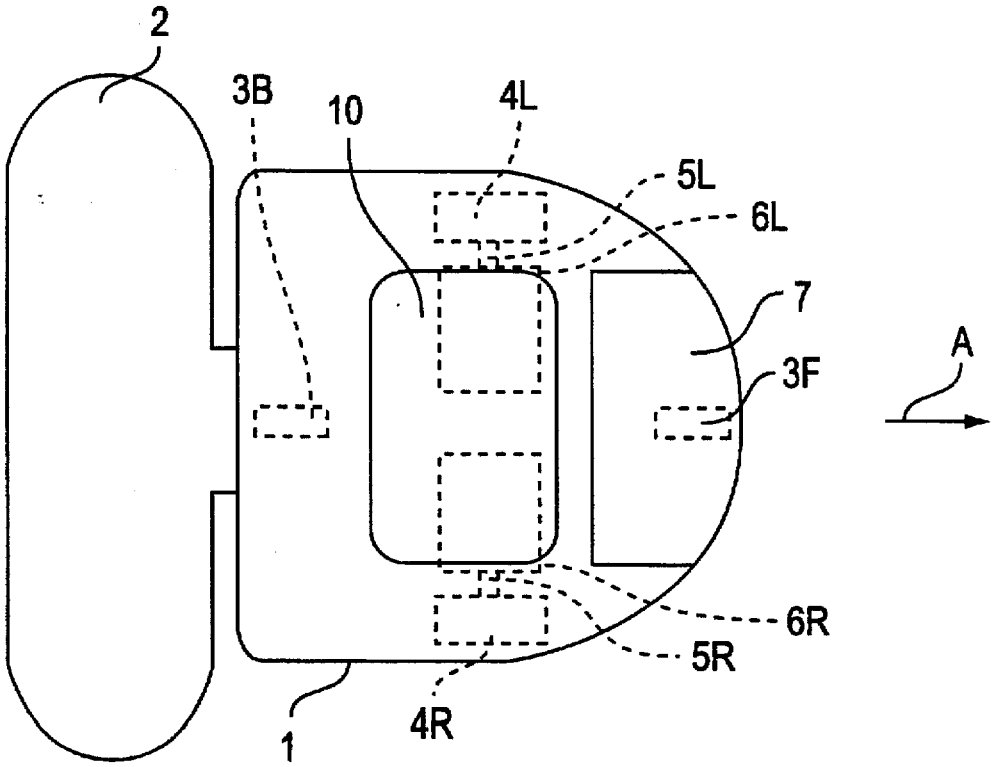
FIG. 4 is a plan view of an unmanned working vehicle of a second embodiment of the present invention.
Figure 5:
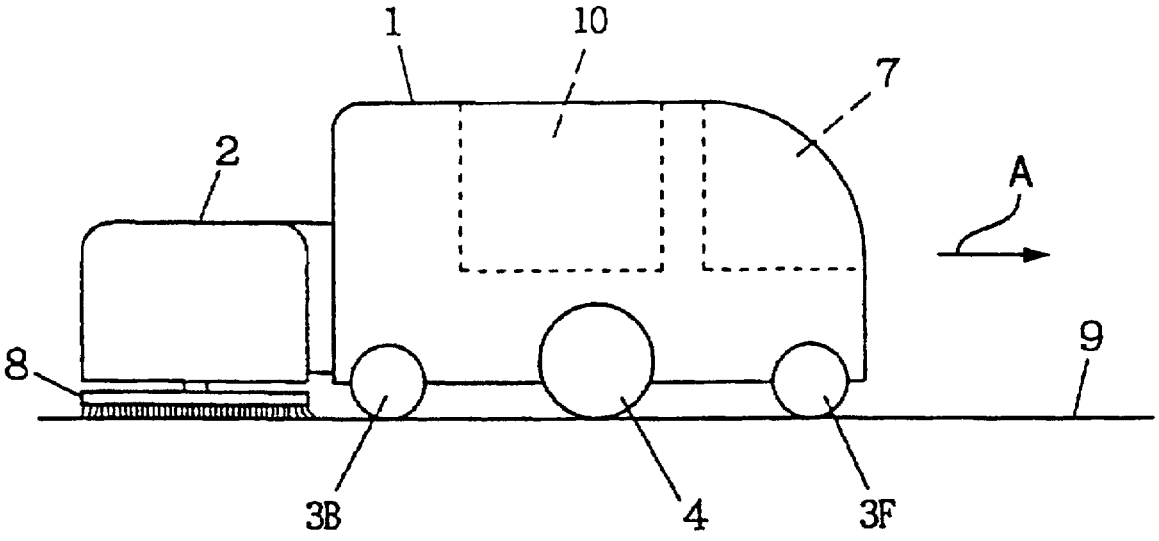
FIG. 5 is a side view of the unmanned working vehicle of the second embodiment of the present invention.

FIGS. 4 and 5 show a plan view and a side view of an unmanned working vehicle of a second embodiment of the present invention. The unmanned working vehicle of the second embodiment is provided by mounting the unmanned working vehicle of the first embodiment with a solution tank 10, and therefore, no description is provided for the entire construction. It is to be noted that the battery 7 and the solution tank 10 are indicated by solid lines in FIG. 4 for ease of understanding.

In the unmanned working vehicle of the second embodiment, the solution tank 10 is provided above the driving wheels 4 in the vicinity of the center of the main body section 1 of the unmanned working vehicle. That is, the solution tank 10 is provided between the battery 7 and the work mechanism section 2.

Figure 6A:
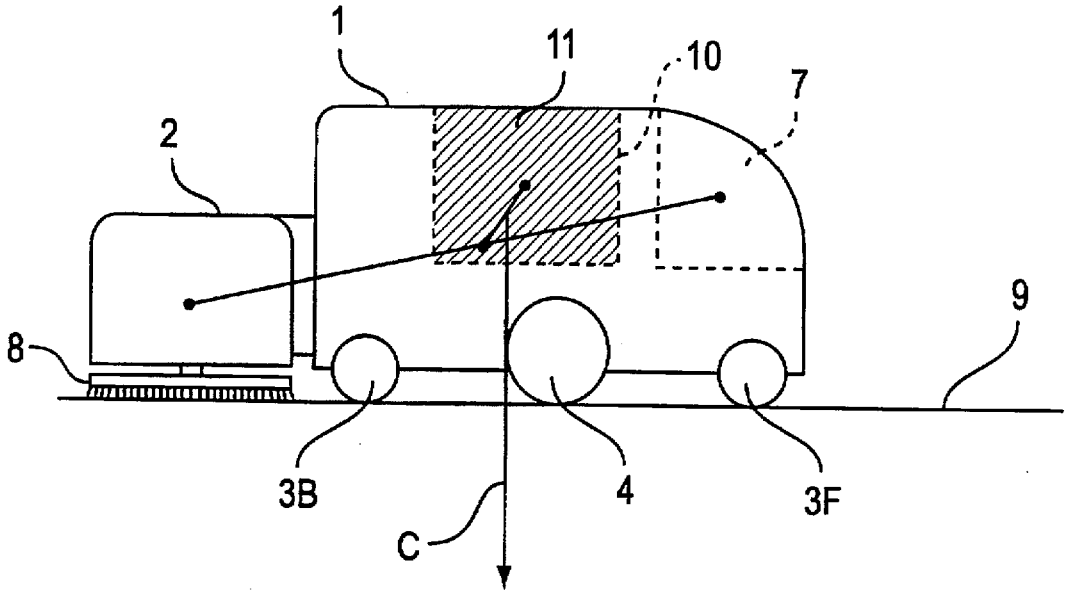
FIGS. 6A and 6B are side views for explaining the shift of the position of the center of gravity before and after the working of the unmanned working vehicle of the second embodiment of the present invention.
Figure 6B:
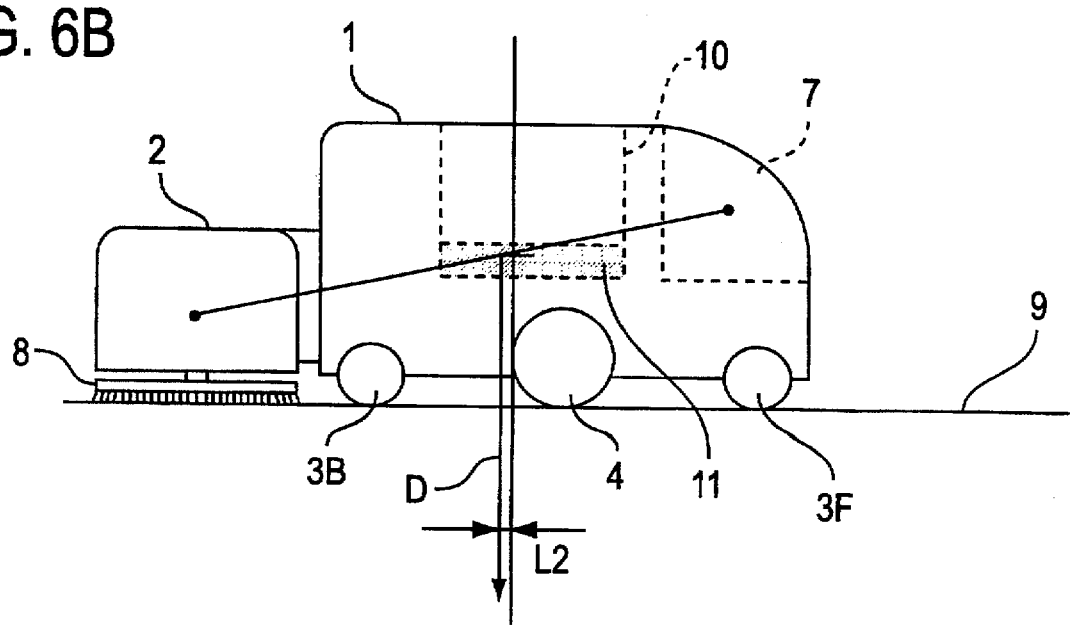

FIGS. 6A and 6B show side views for explaining the shift of the position of the center of gravity of the unmanned working vehicle before and after the cleaning work with a solution. FIG. 6A shows a state before the cleaning work. The solution tank 10 is filled with a solution 11. On the other hand, FIG. 6B shows a state after the cleaning work. Since the cleaning work with the solution 11 has been performed, the solution 11 is reduced.

In this case, according to the second embodiment, not only the weights of the battery 7 and the work mechanism section 2 but also the weight of the solution tank 10 share a greater part of the weight of the entire unmanned working vehicle. In this case, mainly the weights of these three members are the factors for determining the position of the center of gravity of the unmanned working vehicle. In this case, the position of the center of gravity of the unmanned working vehicle of the second embodiment is located in a position indicated by a reference letter C in FIG. 6A. In this case, the position C of the center of gravity is located near the driving wheels 4, meaning that it is the position where a sufficient weight is consistently rested on the driving wheels 4 allowing the wheels to be prevented from slipping.

Then, the solution 11 in the solution tank 10 is used for the cleaning of the floor surface 9, and accordingly as the weight of the solution tank 10 reduces, the position of the center of gravity of the unmanned working vehicle shifts. The position of the center of gravity of the unmanned working vehicle in the case where the solution 11 in the solution tank 10 is reduced is located in a position indicated by a reference letter D in FIG. 6B. In this case, according to the second embodiment, a shift distance L2 between the position D of the center of gravity after the cleaning work and the position C of the center of gravity before the cleaning work (see FIG. 6B) is very small. That is, the position D of the center of gravity is also located near the driving wheels 4, meaning that it is the position where a sufficient weight is consistently rested on the driving wheels 4 allowing the wheels to be prevented from slipping.

That is, according to the unmanned working vehicle of the second embodiment, the shift of the position of the center of gravity occurring as a consequence of the performance of the cleaning work is minimized. Even when the unmanned working vehicle is made to move while performing the cleaning work, the position of the center of gravity is located near the driving wheels 4 and does not shift from the position where the sufficient weight is consistently rested on the driving wheels 4, and therefore, the movement is consistently stabilized. In the second embodiment, it is a matter of course better to set the position so that the position of the center of gravity does not shift at all before and after the cleaning work and the position of the center of gravity is located near the driving wheels 4 for the achievement of the center of gravity consistently rested near the driving wheels 4.

According to the unmanned working vehicle of the second embodiment, at least one of the auxiliary wheels 3F and 3B is provided with a suspension mechanism similar to that of the first embodiment. With this arrangement, even when the solution in the solution tank varies in amount through the cleaning work, the position of the center of gravity of the unmanned working vehicle scarcely shifts. Therefore, the effect of the spring of the suspension is consistently the same, so that the stable movement of the unmanned working vehicle can be achieved.

Although the unmanned working vehicle that is mounted with the solution tank for storing therein the solution for cleaning and cleans the floor surface has been described in connection with the second embodiment, it is a matter of course that the same effect can be obtained with an unmanned working vehicle mounted with a member of which weight varies through a specified work. As the specified work, there can be considered, for example, suction of dust on the floor surface and lawn mowing, seeding and harvesting vegetables and fruits in fields and gardens in addition to the floor surface cleaning.

Although the present intention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An unmanned working vehicle comprising:

a working mechanism section which performs a specific work; and a main body section having a first side and a second side, said first side being located relative to said second side along an advancing direction of said unmanned working vehicle, said working mechanism section positioned at said first side, said main body section including, a drive wheel for moving said unmanned working vehicle, an auxiliary wheel provided one side of said drive wheel with respect to the advancing direction, said auxiliary wheel including a suspension mechanism capable of moving a vertical direction, and a power supply for providing power for driving said working mechanism section and having substantial weight, said power supply being arranged at said second side, a center of gravity of said unmanned working vehicle being proximate said drive wheel as a result of the weights of said working mechanism section and said power supply.

2. The unmanned working vehicle as claimed in claim 1, wherein said working mechanism section is positioned outside said main body section.

3. An unmanned working vehicle comprising:

a working mechanism section which performs a specific work; and a main body section having a first side and a second side, said first side being located relative to said second side along an advancing direction of said unmanned working vehicle, said working mechanism section being positioned at said first side, said main body section including, a drive wheel for moving said unmanned working vehicle, an auxiliary wheel provided one side of said drive wheel with respect to the advancing direction, said auxiliary wheel including a suspension mechanism capable of moving a vertical direction, and a power supply for providing power for driving said drive wheel and having substantial weight, said power supply being arranged at said second side, a center of gravity of said unmanned working vehicle being proximate said drive wheel as a result of the weights of said working mechanism section and said power supply.

4. The unmanned working vehicle as claimed in claim 3, wherein said working mechanism section is positioned outside said main body section.

5. An unmanned working vehicle comprising:

a work mechanism section which performs a specified work; and a main body section having a front end and a rear end with said work mechanism section being positioned proximate the rear end, said main body section including, a drive wheel for moving said unmanned working vehicle, an auxiliary wheel proximate the front end, and a power supply for providing power for driving said work mechanism section and having substantial weight, said power supply being arranged at the front end, opposite from said work mechanism section positioned at the rear end, and directly over said auxiliary wheel, a center of gravity of said unmanned working vehicle being proximate said drive wheel as a result of the weight of said power supply.

6. The unmanned working vehicle as claimed in claim 5, wherein said specified work is cleaning a floor surface.

7. The unmanned working vehicle as claimed in claim 6 further comprising, a weight changing section arranged between said power supply and said work mechanism section, weight of said weight changing section changing as a consequence of cleaning said floor surface.

8. The unmanned working vehicle as claimed in claim 7, wherein said weight changing section is a solution tank filled with a solution for cleaning said floor surface.

9. The unmanned working vehicle as claimed in claim 5, wherein said specified work is carrying items.

10. An unmanned working vehicle comprising:

a work mechanism section which performs a specified work; and a main body section having a front end and a rear end with said work mechanism section being positioned proximate the rear end, said main body section including, a drive wheel for moving said unmanned working vehicle, an auxiliary wheel proximate the front end, and a power supply for providing power for driving said main body section and having substantial weight, said power supply being arranged at the front end, opposite from said work mechanism section positioned at the rear end, and directly over said auxiliary wheel, a center of gravity of said unmanned working vehicle being proximate said drive wheel as a result of the weight of said power supply.

11. The unmanned working vehicle as claimed in claim 10, wherein said specified work is carrying items while moving on a floor surface.

12. The unmanned working vehicle as claimed in claim 10, further comprising:

a weight changing section arranged between said power supply and said work mechanism section, weight of said weight changing section changing as a consequence of said specified work performed by said work mechanism section.

13. The unmanned working vehicle as claimed in claim 10, wherein said specified work is cleaning a floor surface.

* * * * *